United States Patent [19]

Gourley

[11] 4,094,098

[45] June 13, 1978

[54] LOADING BLOCK FOR MUZZLE-LOADING GUN

[76] Inventor: Charles R. Gourley, 1131 Neelys Bend Rd., Madison, Tenn. 37115

[21] Appl. No.: 783,985

[22] Filed: Apr. 4, 1977

[51] Int. Cl.[2] ..... F41C 27/00
[52] U.S. Cl. ..... 42/90
[58] Field of Search ..... 42/90, 87, 88

[56] References Cited

U.S. PATENT DOCUMENTS

| | | | |
|---|---|---|---|
| 1,565 | 4/1840 | Clark | 42/90 |
| 163,404 | 5/1875 | Phillips | 42/90 |
| 184,079 | 11/1876 | Hovis | 42/90 |
| 3,747,252 | 7/1973 | Walker | 42/90 |

*Primary Examiner*—Charles T. Jordan
*Attorney, Agent, or Firm*—Harrington A. Lackey

[57] ABSTRACT

A block for loading the muzzle of a gun, including a plurality of longitudinally spaced shot holes, each shot hole intercepting a coaxially aligned locater recess adapted to fit over the muzzle of the gun to be loaded.

3 Claims, 2 Drawing Figures

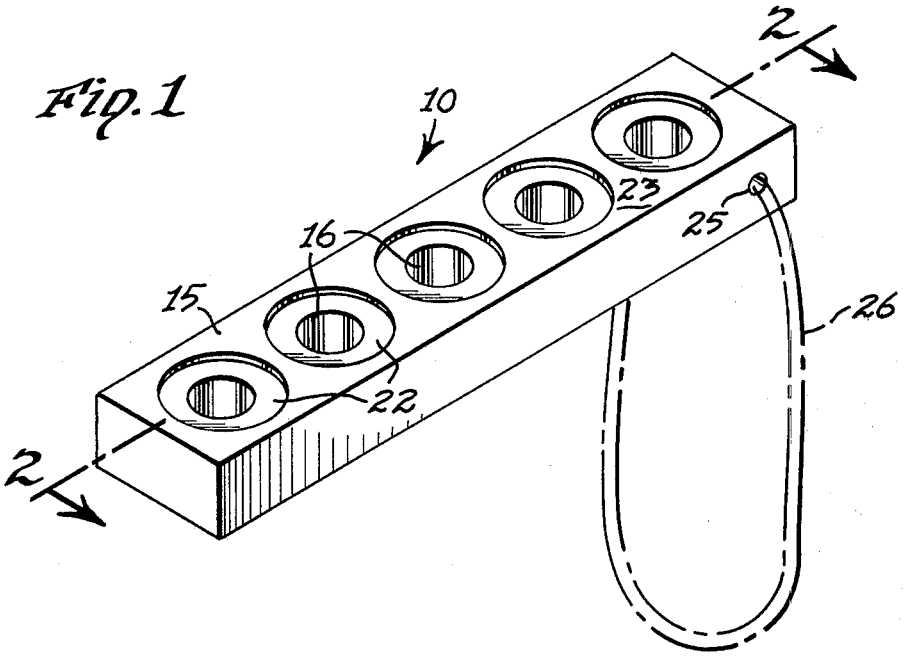
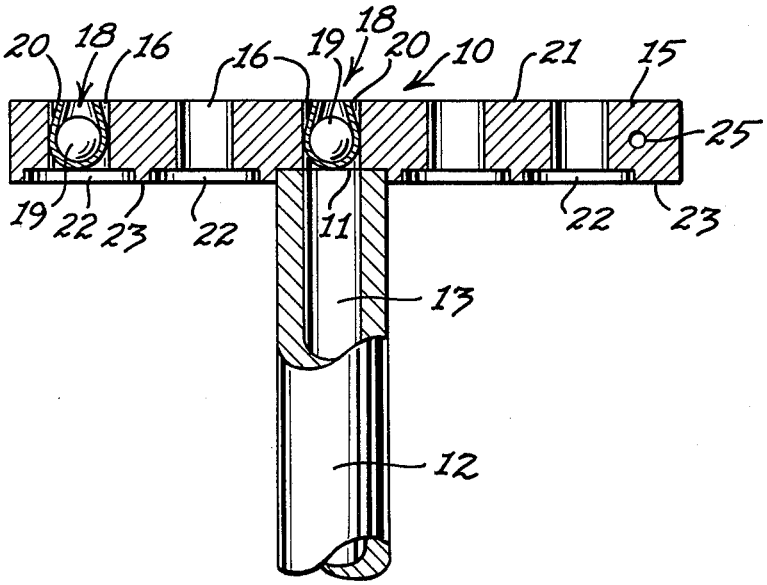
Fig. 2

LOADING BLOCK FOR MUZZLE-LOADING GUN

BACKGROUND OF THE INVENTION

This invention relates to a device for loading a muzzle-loading gun, and more particularly to a loading block for a muzzle-loading gun.

In the conventional method of loading a muzzle-loading gun, such as a musket, the musket ball or minie ball is wrapped in a greased patch and placed into the open muzzle of the gun. An insertion tool is then manually employed to force the patch and ball into the open end of the muzzle. Then a ramrod is employed to force the charge, including the musket ball and patch, down the barrel toward the breech of the gun.

A musket ball insertion tool is disclosed in the U.S. Pat. No. 3,747,252, issued July 24, 1973.

A single charge, muzzle-loading device is disclosed in the Clark U.S. Pat. No. 1,565, issued Apr. 24, 1840.

Multiple-charge loading devices for the muzzle loading of firearms are disclosed in the Phillips U.S. Pat. No. 163,404, issued May 18, 1875 and in the Hovis U.S. Pat. No. 184,079, issued Nov. 7, 1876. Both the Phillips and Hovis patents disclose a rotatable cylindrical loading device including circumferentially spaced charge-receiving holes. Each charge-receiving hole has to be aligned with the muzzle of the gun by rotating the cylinder containing the holes.

SUMMARY OF THE INVENTION

This invention relates to a muzzle-loading device including an elongated block having a plurality of longitudinally spaced shot or charge-receiving holes opening through the top face of the block and extending substantially the full height of the block. Formed in the bottom face of the block are a plurality of cylindrical locater recesses, each recess being coaxially aligned with a shot-receiving hole. Each recess is adapted to slip-fit over the muzzle of the gun to be loaded, so that the corresponding shot hole is coaxially aligned with the muzzle of the gun.

Each of the shot holes is loaded with a charge, including a musket ball, shot ball or minie ball wrapped in a greased patch. Thus, when the hunter or marksman wishes to load his musket, or other muzzle-loading gun, he merely fits the locater recess of any shot hole over the muzzle, forces his shot insertion tool into the top of the shot hole and forces the charge down through the shot hole and into the open end of the muzzle. The loading block is then removed and the ramrod utilized to force the charge the rest of the way down the barrel.

This operation may be repeated each time it is desired to load the gun and until the charges in all the shot holes of the loading block have been exhausted of their charges.

The muzzle-loading block made in accordance with this invention substantially reduces the loading time over conventional methods of loading muzzle-loading guns, such as muskets.

BRIEF DESCRIPTION OF THE DRAWINGS

FIG. 1 is a bottom perspective view of the upside-down loading block made in accordance with this invention; and FIG. 2 is a longitudinal section taken along the line 2—2 of FIG. 1, disclosing the loading block in loading position upon the muzzle of a gun, shown partially in section.

DESCRIPTION OF THE PREFERRED EMBODIMENTS

Referring now to the drawings in more detail, the loading device 10 for loading the muzzle 11 of a gun barrel 12 having a bore 13, includes an elongated block 15, preferably a rectangular parallelepiped made of solid material preferably metal, such as aluminum.

The block 15 is long enough to have formed therein a plurality (five shown in the drawings) of longitudinally spaced cylindrical shot holes 16. The diameter of the cylindrical shot holes 16 is uniform, and equal to, or nearly equal to, the caliber or diameter of the bore 13 of the gun barrel 12. Moreover, the vertical dimension, or thickness, of the block 15 is great enough that the height of each shot hole 16 is sufficient to accommodate the gun charge 18, which includes a shot ball, musket ball or minie ball 19, wrapped in a greased patch 20.

Each shot hole 16 opens through the top face 21 of the block 15 and extends vertically down through the block 15. The lower end of each shot hole 16 terminates and opens into a coaxial locater recess 22 formed in the bottom face 23 of the block 15.

Each locater recess 22 is of a uniform diameter, substantially larger than the diameter of each of the shot holes 16, and substantially equal in diameter to the outer diameter of the gun muzzle 11. Thus, each locater recess 22 is adapted to slipfit over the muzzle 11 of the barrel 12, in order to locate, or fix, the muzzle 11 relative to the corresponding shot hole 16, as illustrated in FIG. 2. When the muzzle 11 is located relative to the shot hole 16, the shot hole 16 is in coaxial alignment with the bore 13, and the diameter of the shot hole 16 is equal to the caliber or diameter of the bore 13. Thus, when the charge 18 is thrust from its shot hole 16, it easily passes into the muzzle bore 13, without obstruction.

A transverse hole or opening 25 may be formed transversely through one end portion of the block 15 to receive a flexible loop member, such as a thong or lanyard 26, so that the loading device 10 may be easily held by the hunter or marksman, or easily suspended from his belt.

In the operation of the loading device 10, each of the shot holes 16 is filled with a charge 18, including a shot ball 19 wrapped with a greased patch 20. FIG. 2 discloses two of the shot holes 16 filled with a charge 18, for illustrative purposes. The other three shot holes 16 are disclosed empty. It will be understood that all of the shot holes 16 will be filled for the most efficient utilization of the loading device 10.

Furthermore, it will be understood that even though five shot holes 16 are disclosed in the drawings, more or fewer shot holes may be included by varying the length of the block 15.

After all the shot holes are filled with a charge 18, the marksman may secure the loading device 10 by suspending the lanyard 26 upon his belt.

When it is desired to load the gun barrel 12, any one of the locater recesses 22 may be placed over the muzzle opening 11 to automatically fix the block 15 relative to the barrel 12, and to automatically vertically align the corresponding shot hole 16 with the bore 13. The marksman then forces the charge 18 downward through the aligned shot hole 16, with an appropriate ball insertion tool, until the charge 18 is lodged within the bore 13 and completely removed from its shot hole 16. The loading device 10 is then removed, and the marksman completes the loading operation by forcing a ramrod down through the muzzle 11 to force the charge toward the breech of the gun.

After the gun is fired, the loading operation is repeated by placing another locater recess 22, aligned with a charge-receiving shot hole 16, over the muzzle 11. This loading operation is repeated after each discharge of the gun, and as long as there remains a shot hole filled with a charge 18.

The utilization of the loading block 10 has reduced the loading time for a muzzle-loading gun or musket from 1½ minutes for conventional muzzle loading without any muzzle-loading device, to 25 seconds.

Since each shot hole 16 is provided with its own coaxial muzzle locater recess 22, the loading operation is expedited, and no moving parts are needed, as contrasted to the rotary-cylinder type of multiple-charge loading devices.

Furthermore, the number of shot holes 16 can be increased considerably, by merely lengthening the block 15 and drilling the additional holes desired and counter-sinking the additional coaxial muzzle locater recesses.

The block 15 is preferably made of solid metal, as opposed to wood and many plastics, in order to increase the wear life of the loading device 10.

What is claimed is:

1. A muzzle-loading device for a gun having a muzzle, comprising:

(a) an elongated block having a top face, a bottom face, and a vertical dimension, (b) a plurality of longitudinally spaced, cylindrical shot holes extending vertically through said block and opening through said top face, each of said shot holes having a uniform diameter substantially equal to the caliber of the muzzle of a gun to be loaded, (c) each of said shot holes having a height great enough to receive a charge for the gun muzzle, (d) a plurality of cylindrical locater recesses formed in said bottom face, equal in number to said shot holes, each locater recess having a uniform diameter substantially equal to the outer diameter of the muzzle of a gun to be loaded, so that each of said recesses is adapted to snugly and coaxially receive said gun muzzle for loading, and (e) each of said locater recesses being vertically coaxially aligned with, and opening into, a different shot hole.

2. The invention according to claim 1 in which the vertical dimension of each of said locater recesses is substantially less than the vertical dimension of each of said shot holes.

3. The invention according to claim 1 in which said block is formed of a solid metal material.

* * * * *